US006182963B1

(12) United States Patent
Yergenson

(10) Patent No.: US 6,182,963 B1
(45) Date of Patent: Feb. 6, 2001

(54) AUTOMATIC FORCE BALANCE ADJUSTMENT FOR SHEET MATERIAL CASSETTE TRAYS

(75) Inventor: Robin P. Yergenson, Eagle, ID (US)

(73) Assignee: Hewlett-Packard Co., Palo Alto, CA (US)

( * ) Notice: Under 35 U.S.C. 154(b), the term of this patent shall be extended for 0 days.

(21) Appl. No.: 09/277,517

(22) Filed: Mar. 26, 1999

(51) Int. Cl.[7] ..... B65H 1/12
(52) U.S. Cl. ..... 271/160; 271/127; 271/171
(58) Field of Search ..... 271/126, 127, 271/160, 171

(56) References Cited

U.S. PATENT DOCUMENTS

| | | | | |
|---|---|---|---|---|
| 4,343,461 | * | 8/1982 | Tomimoti et al. | 271/260 |
| 4,726,698 | * | 2/1988 | Weiss et al. | 271/160 |
| 6,039,315 | * | 3/2000 | Lim | 271/160 |

FOREIGN PATENT DOCUMENTS

| | | | | |
|---|---|---|---|---|
| 0084735 | * | 6/1980 | (JP) | 271/160 |
| 0082744 | * | 7/1981 | (JP) | 271/127 |
| 0291324 | * | 12/1990 | (JP) | 271/126 |
| 404313523 | * | 11/1992 | (JP) | 271/160 |
| 405069955 | * | 3/1993 | (JP) | 271/160 |
| 406016254 | * | 1/1994 | (JP) | 271/160 |

* cited by examiner

*Primary Examiner*—H. Grant Skaggs

(57) ABSTRACT

In a sheet material feed assembly, a sheet material tray including a movable support component is provided. Also provided is a spring adapted to bias the support component in a predetermined direction. A selectively movable sheet retention member is operatively connected to the spring, whereby movement of the sheet retention member automatically affects variation in the biasing force of the spring. The spring can be provided as a pivotable cantilever spring including a central aperture. The sheet retention member can include a ramp member passing through the cantilever spring aperture. The ramp member includes an inclined portion, and a flat portion contiguous with the inclined portion. The sheet retention member can be provided in the form of a rear adjust for accommodating various sheet material lengths within the tray. The movable support component can be mounted for pivoting movement within the tray, and can be provided as a sheet material lift plate. A second spring member can be provided in biasing contact with the lift plate. Also described is a method for automatically adjusting tray force balance forces in a paper tray associated with an imaging system including a sheet material feed assembly. In a first step, a selectively movable sheet retention member is provided. Next, a bias spring, adapted and constructed to exert a selectively variable biasing force on sheet material in the paper tray, is provided. A spring adjustment mechanism is operatively connected to the sheet retention member and to the bias spring. The sheet retention member is then moved to cause the spring adjustment mechanism to selectively vary the biasing force of the bias spring. The sheet retention member can be moved forward to decrease the biasing force of the bias spring, and rearward to increase the biasing force of the bias spring.

18 Claims, 2 Drawing Sheets

AUTOMATIC FORCE BALANCE ADJUSTMENT FOR SHEET MATERIAL CASSETTE TRAYS

FIELD OF THE INVENTION

The present invention relates generally to media trays for sheet material feed systems in imaging devices. Specifically, the present invention relates to automated force balance adjustment mechanisms to accommodate broad ranges of media for sheet material cassette trays.

BACKGROUND OF THE INVENTION

The ever-changing demands of global commerce, coupled with the almost unlimited capabilities of state-of-the-art imaging systems, has resulted in a need for a wide variety of document types and formats. The days of "letter or legal" have gone the way of carbon paper and mimeographs. Imaging systems are capable of handling a variety of standard sizes, such as letter, legal, A4, and A5-ISO, as well as custom sheet sizes.

Rather than require system users to have on hand a different sheet tray for each sheet size, it is known to provide cassette trays having the ability to handle a relatively wide range of sizes. Such trays typically are provided with sliding rear adjusts to accommodate different sheet lengths, and/or sliding side adjusts to accommodate different sheet widths. A spring-biased lift plate is typically provided to urge the sheet stack towards an infeed mechanism, such as feed rollers and the like.

It has been found that the difference in weight between smaller and larger sheet sizes can present problems. For example, if the spring bias of the lift plate is chosen for an "average" sheet size, heavier sheet stacks can have "no-pick" problems, where the spring bias is insufficient to overcome the weight of the stacks while still providing the necessary pick force. At the other end of the spectrum, smaller sheets may have "multi-feed" problems, wherein the pick force exceeds the separation force so that two or more sheets are fed into the feed mechanism simultaneously.

One proposed solution to these problems is to provide manual spring adjustments, where system users are required to adjust various levers and knobs corresponding to individual sheet sizes.

Unfortunately, this solution presents problems of its own. For instance it is difficult or impossible for users to adjust for non-standard sizes. Further, the requirement for independent manual adjustment by the user is inconvenient, and may be easily overlooked.

It is therefore apparent that the need exists for a sheet material tray having a simple, reliable mechanism that will automatically adjust spring bias to paper size without any additional mechanical manipulation by the system user.

SUMMARY OF THE INVENTION

These and other objects are achieved by providing, in a sheet material feed assembly, a sheet material tray including a movable support component. Also provided is a spring adapted to bias the support component in a predetermined direction. A selectively movable sheet retention member is operatively connected to the spring, whereby movement of the sheet retention member automatically affects variation in the biasing force of the spring.

The spring can be provided as a pivotable cantilever spring including a central aperture. The sheet retention member can include a ramp member passing through the cantilever spring aperture. The ramp member includes an inclined portion, and a flat portion contiguous with the inclined portion.

The sheet retention member can be provided in the form of a rear adjust for accommodating various sheet material lengths within the tray. The movable support component can be mounted for pivoting movement within the tray, and can be provided as a sheet material lift plate. A second spring member can be provided in biasing contact with the lift plate.

A method for automatically adjusting tray force balance forces is also set forth. The method is adapted for practice with a paper tray associated with an imaging system including a sheet material feed assembly.

In a first step, a selectively movable sheet retention member is provided. Next, a bias spring, adapted and constructed to exert a selectively variable biasing force on sheet material in the paper tray, is provided. A spring adjustment mechanism is operatively connected to the sheet retention member and to the bias spring. The sheet retention member is then moved to cause the spring adjustment mechanism to selectively vary the biasing force of the bias spring. The sheet retention member can be moved forward to decrease the biasing force of the bias spring, and rearward to increase the biasing force of the bias spring.

DETAILED DESCRIPTION OF THE INVENTION

Figure 1:
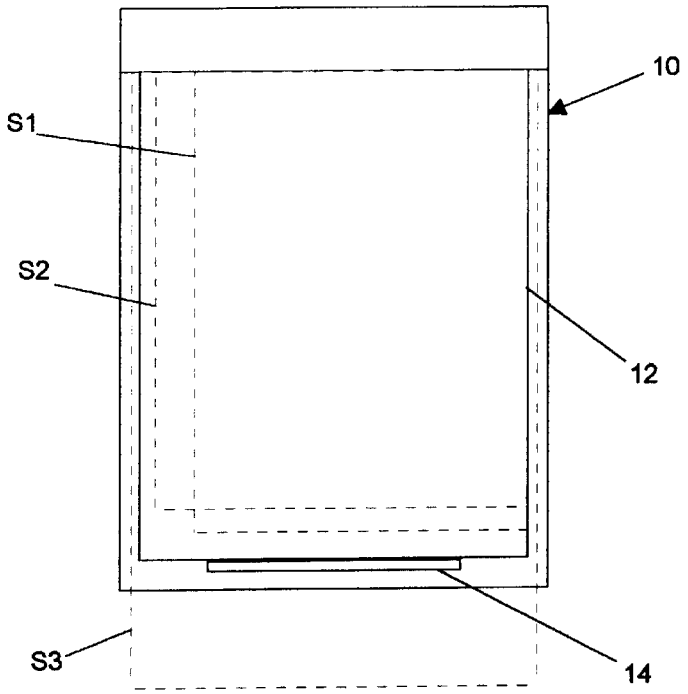
FIG. 1 is a schematic plan view of a sheet material tray in accordance with the principles of the present invention.

A sheet material tray 10 in accordance with the principles of the present invention is shown in FIG. 1. The tray 10 is adapted to receive a plurality of sheets of printable media, such as paper, transparencies, and the like, arranged in a stack 12. A sheet retention member, such as a sliding rear adjust 14, is provided to accommodate different sheet lengths, such as those shown in phantom line as S1, S2, and S3.

Figure 2:
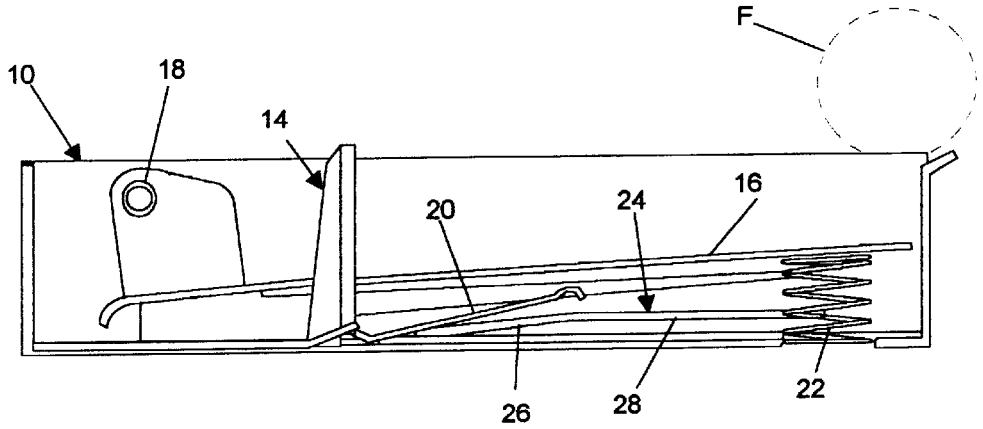
FIG. 2 is a side sectional view taken generally along lines II—II of FIG. 1.

As shown in FIG. 2, the tray 10 includes a movable support component, such as a lift plate 16. The lift plate 16 is pivotably connected to the tray 10 via a pivot support 18. The construction of the lift plate may be executed in accordance with known principles, one example of which may be seen in U.S. Pat. No. 5,236,348.

A bias spring, here provided as a cantilever spring 20, is pivotably connected to a bottom surface of the tray 10. The cantilever spring 20 is placed to bias the lift plate 16 upwardly, thus urging the stack 12 of sheet material towards an infeed device F. An additional spring such as coil spring 22 can be provided to afford supplemental support for the stack 12.

The rear adjust 14 includes a spring adjustment mechanism, here shown as a ramp member 24. The ramp member 24 includes an inclined portion 26 contiguous with a flat portion 28. The rear adjust can be constructed of any suitable material, such as high-impact plastic.

Figure 3:
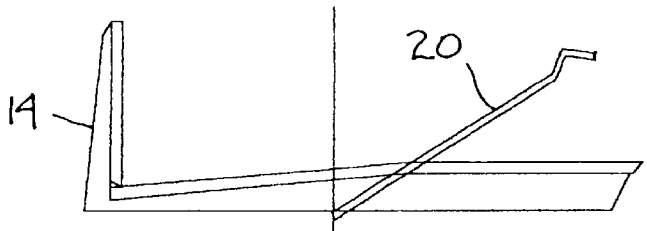
FIG. 3 is a detailed view illustrating a spring adjustment/spring connection.

The ramp 24 is operatively connected to the cantilever spring 20 such that movement of the rear adjust 14 automatically affects variation in the biasing force of the cantilever spring 20. In the illustrated embodiment, the rear adjust 14 is adapted and constructed to change the angle of the cantilever spring 20, which will consequently vary its biasing force on the lift plate 1 6. As illustrated in FIG. 3, the cantilever spring 20 is provided with a central aperture 30 through which passes the ramp 24. The edges of the aperture 30 can be rounded and/or smoothed to avoid damage to the ramp 24.

Figure 4:
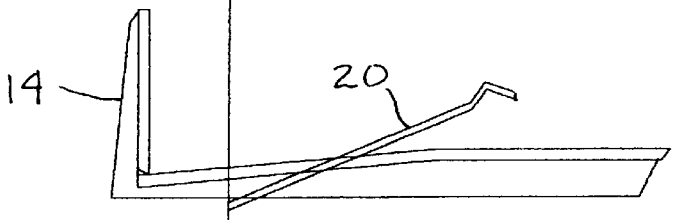
FIG. 4 is a schematic illustration of a spring angle adjustment mechanism in a first position.
Figure 5:
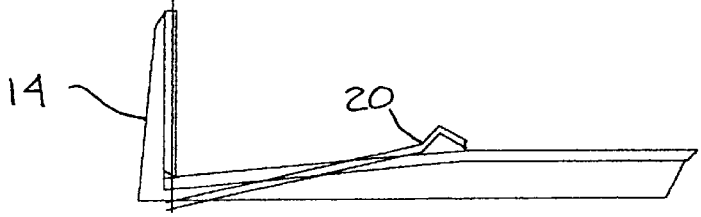
FIG. 5 is a schematic illustration of a spring angle adjustment mechanism in a second position.
Figure 6:
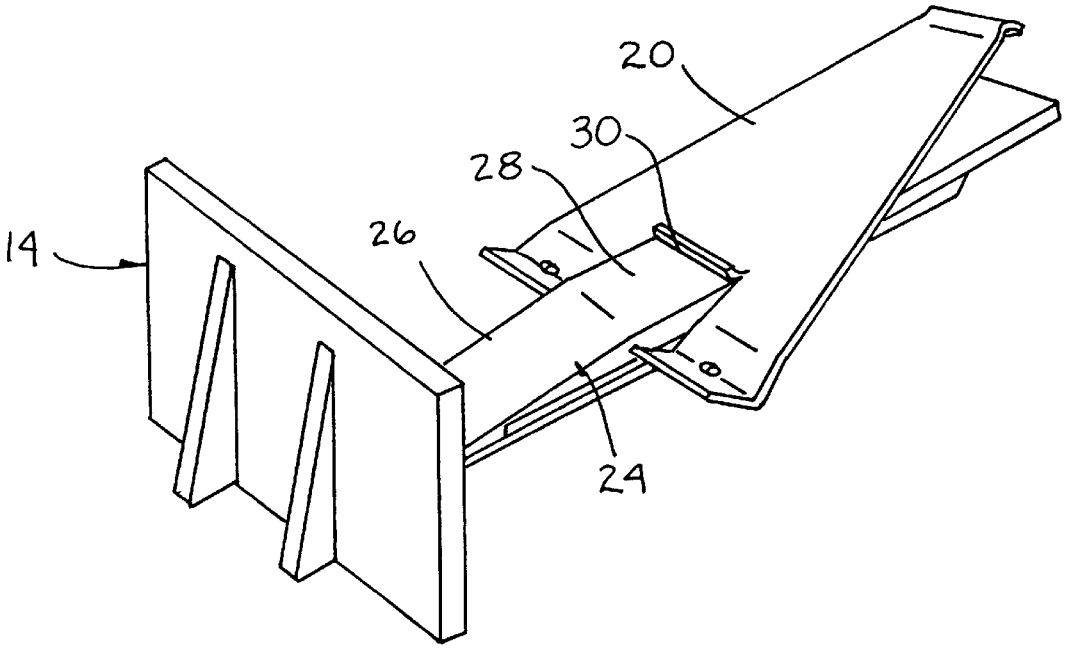
FIG. 6 is a schematic illustration of a spring angle adjustment mechanism in a second position.

Operation of the force balance adjustment mechanism is shown in FIGS. 4 through 6. In the position shown in FIG. 4, the rear adjust 14 is in a position such that the flat portion of the ramp 24 is disposed in the aperture 30 of the cantilever spring 20. This position, corresponding to a rearward placement of the rear adjust 14, places the cantilever spring 20 at its greatest angle with respect to the bottom plane of the tray 10. In this position, the cantilever spring 20 has its greatest biasing force.

In the position shown in FIG. 5, the rear adjust 14 is in a position such that a forward part of the inclined portion 26 of the ramp 24 is disposed in the aperture 30 of the cantilever spring 20. This position, corresponding to an intermediate placement of the rear adjust 14, places the cantilever spring 20 within a middle angular range with respect to the bottom plane of the tray 10. In this position, the cantilever spring 20 has an intermediate biasing force.

In the position shown in FIG. 6, the rear adjust 14 is in a position such that the rearmost part of the inclined portion 28 of the ramp 24 is disposed in the aperture 30 of the cantilever spring 20. This position, corresponding to a forward placement of the rear adjust 14, places the cantilever spring 20 at its least angle with respect to the bottom plane of the tray 10. In this position, the cantilever spring 20 has its lowest biasing force.

Although the present invention has been described with reference to specific embodiments, those of skill in the art will recognize that changes may be made thereto without departing from the scope and spirit of the invention.

What is claimed is:

1. In a sheet material feed assembly, a sheet material tray comprising the following:

a movable support component;

a cantilever spring adapted to bias the support component in a predetermined direction;

a selectively movable sheet retention member operatively connected to the spring;

a ramp member secured for movement with the sheet retention member in a position below the spring;

whereby movement of the ramp member with the sheet retention member automatically affects variation in the biasing force of the spring.

2. A sheet material tray in accordance with claim 1, wherein the movable support component is mounted for pivoting movement within the tray.

3. A sheet material tray in accordance with claim 2, wherein the movable support component comprises a sheet material lift plate.

4. A sheet material tray in accordance with claim 1, further comprising a second spring member in biasing contact with the lift plate.

5. A sheet material tray in accordance with claim 1, wherein the cantilever spring includes a central aperture, and the ramp member passes through the cantilever spring aperture.

6. A sheet material tray in accordance with claim 5, wherein the ramp member includes an inclined portion, and a flat portion contiguous with the inclined portion.

7. A sheet material tray in accordance with claim 6, wherein the sheet retention member comprises a rear adjust for accommodating various sheet material lengths within the tray.

8. In a sheet material tray associated with an imaging system including a sheet material feed assembly, an automated tray force balance adjustment mechanism comprising the following:

a selectively movable sheet retention member;

a cantilever bias spring adapted and constructed to exert a selectively variable biasing force on sheet material in the paper tray; and a spring adjustment ramp mechanism operatively connected for movement with the sheet retention member and to the bias spring in a position below the bias spring;

whereby movement of the sheet retention member, through and with the spring adjustment mechanism, affects variation in the biasing force of the bias spring.

9. An adjustment mechanism in accordance with claim 8, wherein the spring adjustment mechanism comprises a ramp member secured to the sheet retention member.

10. An adjustment mechanism in accordance with claim 9, wherein the cantilever spring includes a central aperture, and the ramp member of the spring adjustment mechanism passes through the cantilever spring aperture.

11. An adjustment mechanism in accordance with claim 10, wherein the ramp member includes an inclined portion, and a flat portion contiguous with the inclined portion.

12. An adjustment mechanism in accordance with claim 8, wherein the sheet retention member comprises a paper size adjustment member.

13. An adjustment mechanism in accordance with claim 12, wherein the sheet retention member comprises a rear adjust for accommodating various sheet material lengths within the tray.

14. An adjustment mechanism in accordance with claim 8, wherein the sheet material tray includes a lift plate, and the bias spring contacts the lift plate.

15. An adjustment mechanism in accordance with claim 14, further comprising a second spring member in biasing contact with the lift plate.

16. In a paper tray associated with an imaging system including a sheet material feed assembly, a method for automatically adjusting tray force balance forces, the method comprising the following steps:

providing a selectively movable sheet retention member movable in both a forward and a rearward direction with respect to a front and a rear of the paper tray;

providing a bias spring adapted and constructed to exert a selectively variable biasing force on sheet material in the paper tray;

providing a spring adjustment ramp mechanism operatively connected for movement with the sheet retention member and to the bias spring in a position below the bias spring; and moving the sheet retention member forward and rearward to cause the spring adjustment mechanism to selectively vary the biasing force of the bias spring.

17. A method according to claim 16, wherein the step of moving the sheet retention member comprises moving the sheet retention member forward to decrease the biasing force of the bias spring.

18. A method according to claim 17, wherein the step of moving the sheet retention member comprises moving the sheet retention member rearward to increase the biasing force of the bias spring.

* * * * *